US012428181B2

(12) United States Patent
Zweekhorst et al.

(10) Patent No.: US 12,428,181 B2
(45) Date of Patent: Sep. 30, 2025

(54) SYSTEM AND METHOD FOR HANDLING PACKAGING UNITS, AND MANIPULATOR UNIT

(71) Applicant: Moba Group B.V., Barneveld (NL)

(72) Inventors: Paul Henri Zweekhorst, Austerlitz (NL); Simon Jan Verkuijl, Harderwijk (NL)

(73) Assignee: MOBA GROUP B.V., Barneveld (NL)

( * ) Notice: Subject to any disclaimer, the term of this patent is extended or adjusted under 35 U.S.C. 154(b) by 19 days.

(21) Appl. No.: 18/024,144

(22) PCT Filed: Sep. 13, 2021

(86) PCT No.: PCT/NL2021/050555
§ 371 (c)(1),
(2) Date: Mar. 1, 2023

(87) PCT Pub. No.: WO2022/055356
PCT Pub. Date: Mar. 17, 2022

(65) Prior Publication Data

US 2023/0264841 A1 Aug. 24, 2023

(30) Foreign Application Priority Data

Sep. 11, 2020 (NL) ..... 2026455

(51) Int. Cl.
*B65B 5/10* (2006.01)
*B65B 5/06* (2006.01)
(Continued)

(52) U.S. Cl.
CPC ..... *B65B 5/105* (2013.01); *B65B 5/06* (2013.01); *B65B 23/02* (2013.01); *B65B 43/46* (2013.01); *B65B 61/22* (2013.01)

(58) Field of Classification Search
CPC ..... B65B 43/46; B65B 5/06; B65B 5/068; B65B 5/105; B65B 23/02; B65B 61/22;
(Continued)

(56) References Cited

U.S. PATENT DOCUMENTS 3,517,831 A * 6/1970 Winfried ..... B65G 60/00 414/789.6
3,986,620 A * 10/1976 Wilde ..... B65G 57/03 414/790.4
(Continued)

FOREIGN PATENT DOCUMENTS

DE 102013021533 A1 * 3/2015 ..... B65G 61/00
EP 1502884 2/2005
(Continued)

OTHER PUBLICATIONS

Screen captures from YouTube video clip entitled "Moba Total Solution Provider", uploaded on Aug. 5, 2011 by user "MobaGroup Barneveld". Retrieved from Internet: <https://www.youtube.com/watch?v=1UjmUCVR6Mo&list=PLC254767BD280F22A&index=48> (Year: 2011).*
(Continued)

*Primary Examiner* — Joshua G Kotis
(74) *Attorney, Agent, or Firm* — Stephen J. Weyer, Esq.; Stites & Harbison PLLC

(57) ABSTRACT

System for handling packaging units, comprising: —a pallet supporter (2) configured for supporting at least one pallet (1); —a package feeding track (8) for feeding the packaging units (4) towards a first area near the pallet supporter (2); —a box feeding track (7) for feeding empty packaging boxes (6) towards a second area near the pallet supporter (2); —a manipulator unit (3) configured to move an empty box (6) from the box feeding track (7) onto a pallet (1) supported by the pallet supporter (2), wherein the manipulator unit (3) is also configured to move packaging units (4) into a box (6)
(Continued)

Figure 1:
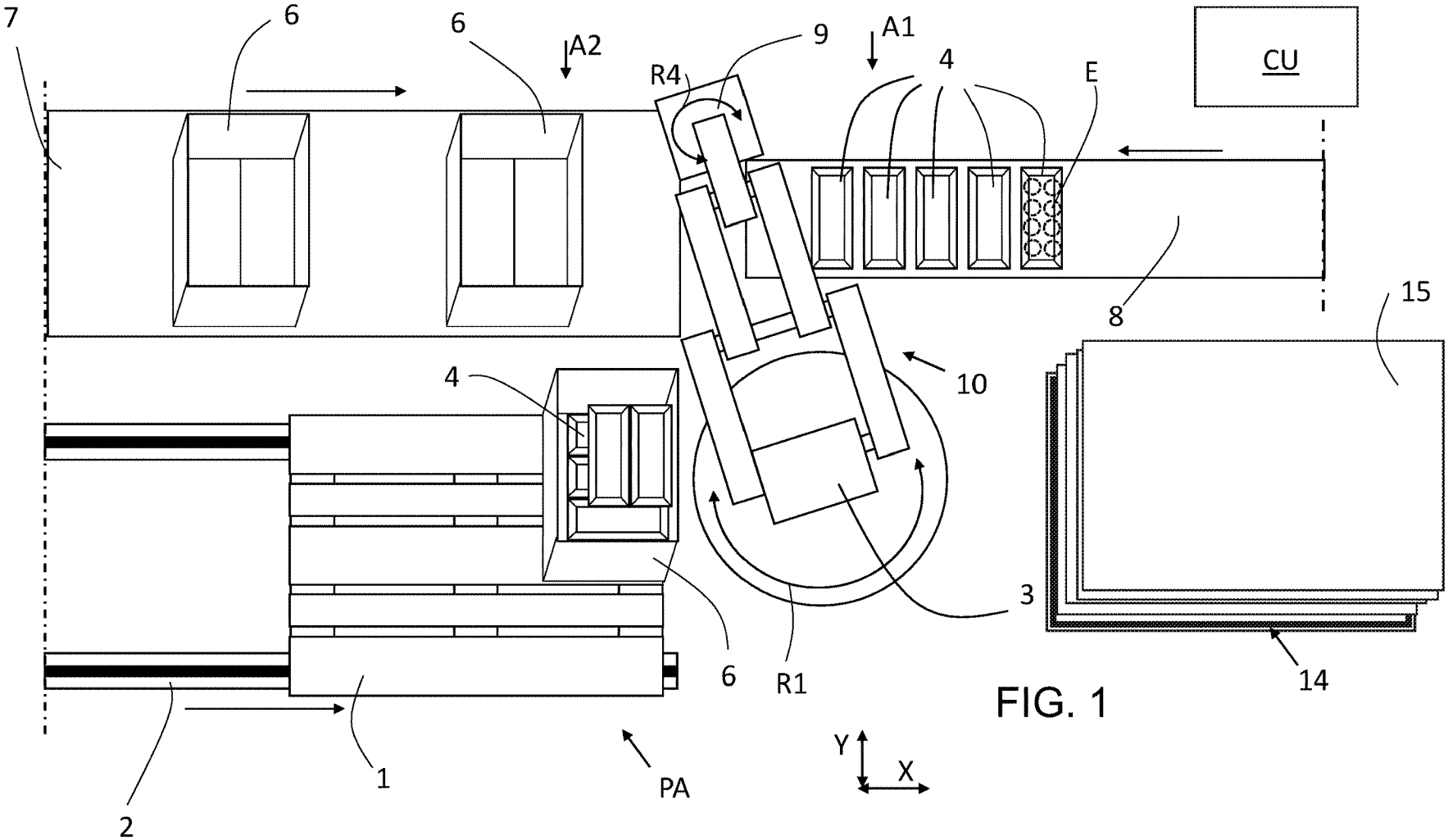

supported on a pallet (1) supported by the pallet supporter (2). The invention also provides an innovative method for handling packaging units.

10 Claims, 3 Drawing Sheets

(51) Int. Cl.
*B65B 23/02* (2006.01)
*B65B 43/46* (2006.01)
*B65B 61/22* (2006.01)

(58) Field of Classification Search
CPC ..... B65B 2220/16; B65G 2201/0235–0261; B65G 2201/0267; B65G 57/24; B65G 57/245; B65G 61/00; B65G 57/005; G05B 2219/40006; B25J 9/1687
See application file for complete search history.

(56) References Cited

U.S. PATENT DOCUMENTS

| | | | | |
|---|---|---|---|---|
| 6,061,996 | A * | 5/2000 | Vissers | B65G 47/647 53/247 |
| 6,237,978 | B1 * | 5/2001 | Bliss | B65G 47/90 294/198 |
| 7,409,812 | B2 * | 8/2008 | Gilmore | B65G 57/04 53/473 |
| 7,490,883 | B2 | 2/2009 | Doppenberg | |
| 7,547,052 | B2 * | 6/2009 | Yohe | B65G 47/90 294/197 |
| 9,156,570 | B2 * | 10/2015 | Lomerson, Jr. | B65B 61/207 |
| 10,192,195 | B1 * | 1/2019 | Brazeau | B25J 9/1661 |
| 10,759,133 | B2 * | 9/2020 | Capoia | B31B 50/16 |
| 2007/0204569 | A1 | 9/2007 | Doppenberg | |
| 2008/0229708 | A1 * | 9/2008 | Schulte | B65G 61/00 414/788.1 |
| 2009/0320417 | A1 * | 12/2009 | Gilmore | B65G 47/90 53/235 |
| 2011/0293397 | A1 * | 12/2011 | Lomerson, Jr. | B25J 15/0616 414/800 |
| 2012/0083920 | A1 * | 4/2012 | Suyama | B65B 55/20 198/346.2 |
| 2013/0036716 | A1 * | 2/2013 | Tsutsumi | B65B 7/20 53/564 |
| 2013/0283731 | A1 * | 10/2013 | Komp | B65B 35/38 53/268 |
| 2014/0142751 | A1 * | 5/2014 | Takizawa | B25J 9/0093 700/245 |
| 2016/0167228 | A1 * | 6/2016 | Wellman | B25J 9/1602 901/3 |
| 2016/0272354 | A1 * | 9/2016 | Nammoto | B25J 13/085 |
| 2018/0043650 | A1 * | 2/2018 | Heath | B25J 11/00 |
| 2020/0198823 | A1 * | 6/2020 | Bauer | B65B 43/145 |
| 2022/0143810 | A1 * | 5/2022 | Campa Monroy | B65B 5/10 |
| 2022/0289496 | A1 * | 9/2022 | Nagata | B65G 43/08 |

FOREIGN PATENT DOCUMENTS

| | | | | |
|---|---|---|---|---|
| EP | 1787910 | | 5/2007 | |
| EP | 2500152 | | 9/2012 | |
| EP | 2500152 | A1 * | 9/2012 | B25J 15/0052 |
| MX | 2019002582 | A * | 9/2020 | B65B 5/10 |
| WO | WO-2019004198 | A1 * | 1/2019 | B25J 15/06 |
| WO | WO-2019049773 | | 3/2019 | |
| WO | WO-2019049773 | A1 * | 3/2019 | B25J 15/04 |

OTHER PUBLICATIONS

International Preliminary Report On Patentability dated Dec. 5, 2022 in International Application No. PCT/NL2021/050555.

International Search Report dated Jan. 12, 2022 in International Application No. PCT/NL2021/050555.

Written Opinion dated Jan. 12, 2022 in International Application No. PCT/NL2021/050555.

Third Party Observations dated Sep. 23, 2024 in European application No. 21794208.5.

Robotic case Palletizer (http://www.youtube.com/watch?v=oXilPEDNTF8) May 12, 2020 (BW Integrated systems).

Robotix box erecting and case packing (http://youtu.be/lSmgogwnodM?si=eQdOa4l6jlUMtiTV) Aug. 14, 2020 (Andrew Donald Design Engineering Pty Ltd).

* cited by examiner

SYSTEM AND METHOD FOR HANDLING PACKAGING UNITS, AND MANIPULATOR UNIT

The invention relates to a system for packing packaging units in packaging boxes.

Such systems are known from the prior art, see for example EP1787910 which discloses a system for processing packaging units such as egg containers. The known system includes a package feeding track for feeding the packaging units, a box feeding track for feeding empty packaging boxes, a box discharge track for discharging filled packaging boxes, a gripper head for engaging the packaging units and placing these from a pick-up portion of the package feeding track into the packaging boxes at a filling location of the box discharge track, and a control unit for executing successive packing cycles. In the known system all movements of the moving components mentioned are performed in a single vertical plane. The system can e.g. be intended for stacking the packaging units (e.g. egg containers containing eggs) into outer-boxes.

Also, systems are known for stacking egg trays into crates, or onto pallets, for example the MR30 Case-display-combi marketed by the applicant. The MR30 system can be set up either as case packer or as a pallet loader (see the movie on Youtube: www.youtube.com/watch?v=mMtWdWC-V0A).

WO2019/049773 discloses a transfer device provided with a plurality of exchangeable head parts. Par. [0033] discloses that as a transfer device, a transfer device for transferring a cardboard box or container filled with egg packs or trays to a transportation pallet may be used. The head portion transfers the cardboard box or container onto the transport pallet to be placed from the temporary standby area provided on the transport device or adjacent to the transport device. As the head portion, at least two types of head portions are provided, that is, a head portion corresponding to a cardboard box and a head portion corresponding to a container. For example, the head portion corresponding to the corrugated cardboard box includes a plurality of suction members whose holding mechanism can be sucked on the upper surface of the corrugated cardboard box. The head portion corresponding to the container is provided with a gripping member capable of gripping both ends of the container by the holding mechanism."

The present invention aims at providing more efficient handling of packaging units, e.g. (but not limited to) packaging units that contain relatively fragile products such as eggs. In particular, the invention aims at efficiently handling relatively large numbers of packaging units for further distribution, in a reliable and durable manner. Besides, an aspect of the invention aims at swiftly and stably loading packaging units onto pallets.

To this aim there is provided a system for handling packaging units, comprising:

- a pallet supporter configured for supporting at least one pallet;
- a package feeding track for feeding the packaging units towards a first area near the pallet supporter;
- a box feeding track for feeding empty packaging boxes towards a second area near the pallet supporter;
- a manipulator unit configured to move an empty box from the box feeding track onto a pallet supported by the pallet supporter, wherein the manipulator unit is also configured to move packaging units into a box supported on a pallet supported by the pallet supporter.

In this way, efficient handling of large numbers of packaging units (and boxes) can be achieved. Therein, packaging units can be packed (stacked) into boxes that are loaded (stacked) onto a pallet. In particular, the boxes as such are different from the packaging units (i.e. the boxes are to receive the packaging units).

In particular, the manipulator unit can provide two functions, namely placing empty boxes (received from the box feeding track) onto a pallet, as well as filling placed boxes with supplied packaging units (supplied from the respective package feeding track). Thus, loading of pallets can be achieved swiftly and efficiently using a relatively small overall system footprint. Besides, the manipulator unit experiences relatively low manipulating forces in case of handling relatively light-weight products (such as egg containing trays or egg containing packs) as well as relatively light-weight empty packaging boxes. In particular, in an embodiment, it has been found that an egg container manipulator unit (e.g. an egg tray or egg pack handling robot) is sufficiently strong for lifting empty (outer) packaging boxes (which may have a maximum mass of 5 kg, in particular 3 kg), and therefore, such a unit can be configured for providing both actions of moving empty (outer) packaging boxes and moving filled egg containing packaging units (which usually also have a maximum mass of 3 kg; e.g. a carton egg tray containing 30 medium to large eggs has a maximum mass of approximately 2 kg).

Particularly, the box feeding track is separate from the package feeding track (i.e. boxes are fed via a different—separate—path than a path of packages during operation).

After a pallet, supported on the pallet supporter, has been loaded with one or more packaging boxes, the one or more packaging boxes being filled with the packaging units, the resulting loaded pallet (which can be relatively heavy) can be removed from the loading area (e.g. by the pallet supporter), after which a next (empty) pallet can be received at the respective pallet loading site to be loaded by the manipulator unit.

It will be appreciated that the manipulator unit can be configured in various ways. It can be e.g. a robot, in particular a manipulator unit that includes a manipulator head, movable in three orthogonal directions, e.g. by a manipulator arm (e.g. an articulated robot). Preferably, the head is also rotatable about a substantially vertical axis. The manipulator head can include a gripper configured for releasingly holding an empty box by a side wall and/or bottom wall of the box. Also, the manipulator head can include e.g. a pair of opposite spaced-apart gripper plates or blades, configured for releasingly holding one or more (e.g. an array) of filled packaging units there-between. It should be observed that the manipulator head can also be configured differently, wherein the gripper for gripping an empty box can also be capable of (and configured for) lifting a filled packaging unit.

Further, an aspect of the invention provides an innovative method for handling packaging units, for example a method utilizing a system according to the invention, the method including:

- supporting at least one pallet in a pallet loading area;
- feeding filled packaging units towards a first area near the pallet loading area;
- feeding empty packaging boxes towards a second area near the pallet loading area that is spaced-apart from said first area;
- moving, by a manipulator unit, an empty packaging box from the second area onto the pallet; and e.g. subsequently iteratively moving, by the same manipulator unit, packaging units from the first area into the box supported on the pallet.

In particular, the manipulator unit can move a plurality of empty boxes to the pallet, to be filled with the packaging units.

In this way the above-mentioned advantages can be achieved. For example, the pallet can be loaded in an efficient manner, by a single manipulator unit, to receive a large number of filled packaging units in a number of respective packaging boxes. Both the empty boxes and filled packaging units are handled by the same manipulator unit. The resulting loaded pallet can be heavy, it may e.g. weigh at least 500 kg, and can be removed from the loading area after loading to be processed further (e.g. shipped).

Figure 2:
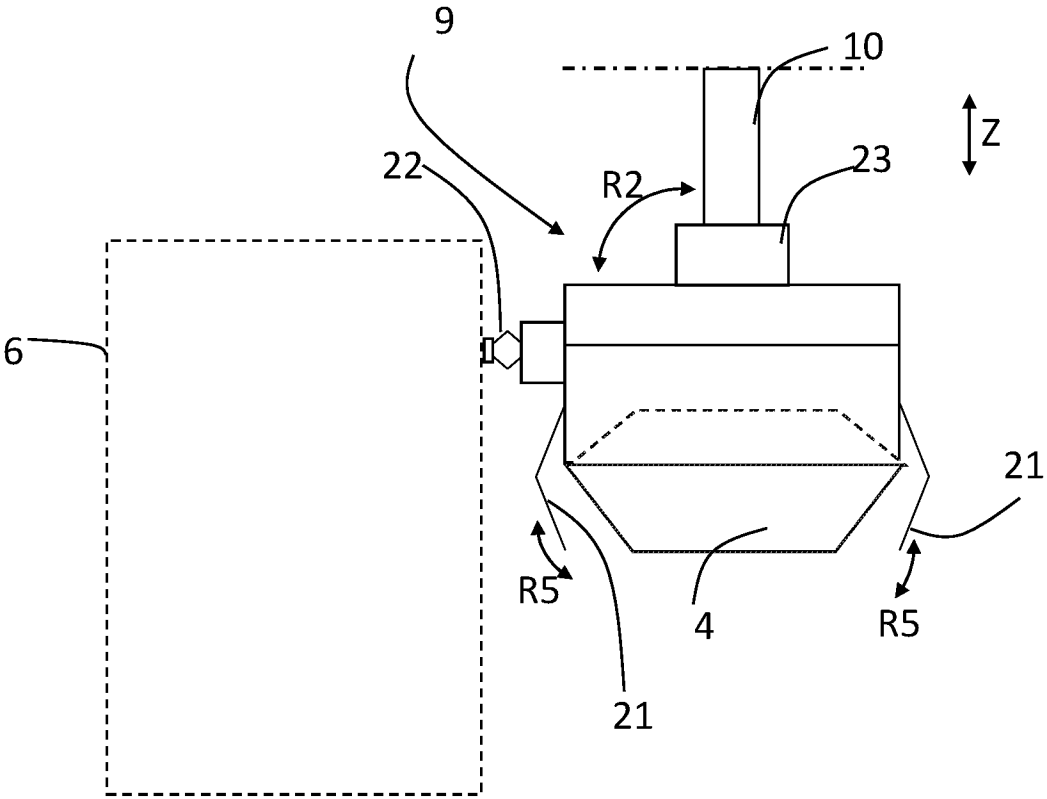
Figure 3:
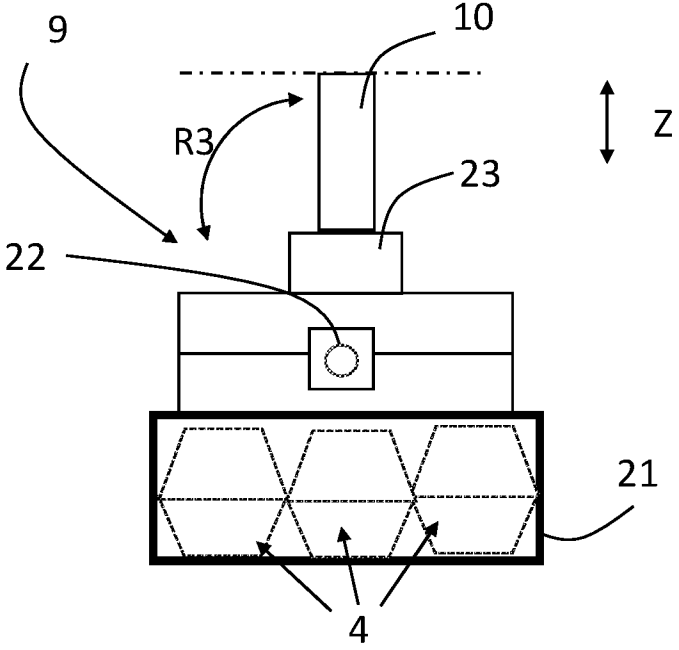

In the following, the invention will be explained further using exemplary embodiments and drawings. The drawings are schematic. In the drawings, similar or corresponding elements have been provided with similar or corresponding reference signs. In the drawings:

FIG. 1 schematically a top view of a non-limiting example of an innovative system for packing packaging units in packaging boxes;

FIG. 2 a side view of a manipulator head of the system shown in FIG. 1; and FIG. 3 a front view of the manipulator head.

The drawings depict a system for handling filled packaging units 4 and in particular for packing filled packaging units 4 in packaging boxes 6.

The system can be configured for handling various types of (outer) packaging boxes 6 and packaging units 4, for example packaging boxes having substantially rectangular boundaries and a rectangle-shaped supporting surface, and filled packaging units 4 having substantially rectangular boundaries and a rectangle-shaped supporting surface. Each packaging box 6 can be configured for receiving a stack of the filled packaging units 4. Each packaging unit 4 can e.g. be a substantially closed product container (as is shown in the present drawings), holding a plurality of products (e.g. eggs, see FIG. 1 showing eggs E with dashed lines in one of the units 4). Alternatively, each packaging unit can be an open tray having a plurality of product receiving nests, for carrying a plurality of products (e.g. stackable egg trays, filled with eggs). In a preferred embodiment, a mass of each empty packaging box 6 is at most 5 kg, in particular at most 3 kg. Similarly, the mass of each filled product containing packaging unit can be at most 3 kg.

The system preferably includes:

- a pallet supporter 2 configured for supporting at least one pallet 1 in a pallet loading area PA;
- a package feeding track 8 for feeding the packaging units 4 towards a first area A1 near the pallet supporter 2 (in particular a first area A1 near the pallet loading area PA);
- a box feeding track 7 (separate from the package feeding track 8) for feeding empty packaging boxes 6 towards a second area A2 near the pallet supporter 2 (in particular a second area A2 near the pallet loading area PA, and in particular a second area A2 that is spaced-apart from or separate/remote from said first area A1); and
- a manipulator unit 3 configured to move empty boxes 6 from the second area A2 (provided/defined by the box feeding track 7), onto a pallet 1 supported by the pallet supporter 2.

Advantageously, the manipulator unit 3 is also configured to move packaging units 4 (from the first area A1) into a box 6 supported on a pallet 1 supported by the pallet supporter 2, as will be explained in more detail below.

In particular, each of the pallet supporter 2, the package feeding track 8 and the box feeding track 7 can extend in a substantially horizontal direction at and/or near a location of the manipulator unit 3. The first area A1 and second area A2 may be at substantially the same vertical level but that is not required. Similarly, the first area A1 and/or second area A2 on one hand and the pallet supporting area PA on the other may be at substantially the same vertical level (but that is not required).

The pallet supporter 2 can e.g. be a pallet conveyor, configured for conveying pallets 1 to and/or away from the pallet loading area PA (that is located near the manipulator unit 3). During operation, the pallet conveyor 2 can e.g. convey empty pallets 1 to the manipulator unit 3 (to be loaded there-by) and loaded pallets 1 away from the manipulator unit 3. Pallet conveyors as such are known, and can e.g. include driven endless pallet conveying means as will be appreciated by the skilled person.

The package feeding track 8 can be configured in various ways, and can e.g. include an endless conveyor (e.g. belt conveyor) for transporting filled packaging units 4 into the first area A1, to be picked up by the manipulator unit 3. For example, a package filling station (not shown) can be associated with or located upstream of the package feeding track 8, for filling packaging units with products and moving filled packaging units 4 to the feeding track 8.

In the same way, the box feeding track 7 can include an endless conveyor (e.g. an endless belt conveyor) for feeding empty packaging boxes 6 towards the second area A2 (to be picked up by the manipulator 3). An empty box providing station (not shown) can be associated with the box feeding track 7 for delivering empty boxes 6 to that track.

Optionally, the system can include an intermediate structure delivery station 14, for providing spacer structures (e.g. sheets or spacer-means) 15 near the manipulator unit 3. In that case it is preferred that the manipulator unit 3 is also configured for transferring spacer structures 15 from the respective station 14 to the pallet loading area PA, in particular for covering one or more (filled) boxes 6 that have been loaded on a pallet 1.

As follows from FIGS. 1-3, the manipulator unit 3 can include a manipulator head 9, movable in three orthogonal directions (x, y, z) by a manipulator arm, e.g. an articulated arm 10 (know a such). Thus, the manipulator unit 3 is configured for moving the head 9 to each of the first area A1, second area A2 and pallet loading area PA, as well as the optional spacer structure providing station 14.

For example, the manipulator unit 3 can include an articulated robot, having an articulated arm 10, a distal end of the arm 10 having a mounting structure for holding a robot manipulator head 9. The manipulator unit 3 can e.g. be configured for rotating the respective articulated arm 10 (and head 9) about a vertical axis (indicated by arrow R1 in FIG. 1). Besides, the manipulator unit 3 can e.g. be configured to pivot the head 9 with respect to the arm 10 in one or more pivot directions, as is indicated by arrows R2 and R3 in FIGS. 2, 3, and/or to rotate the head 9 about a vertical axis with respect to the arm (cf. arrow R4 in FIG. 1), allowing a large number of degrees of freedom for the manipulator head 9. The manipulator unit 3 can include various electric, pneumatic and/or hydraulic actuators (known as such) for providing respective manipulator translations and/or rotations as is clear to the skilled person.

As follows from the drawing the manipulator head 9 can include a gripper 22 configured for releasingly gripping and holding (and picking up) an empty box 6, e.g. by a side wall and/or bottom wall of the box 6. A gripped empty packaging box 6 is indicated by dashed-lines in FIG. 2. Optionally, such a gripper 22 of the manipulator head 9 can be used by the manipulator 3 for releasingly gripping (and picking up) a said spacing structure 15, to move a spacing structure from the station 14 to the pallet loading area PA.

The manipulator head 9 can e.g. include a suction means, for example one or more vacuum cups 22, for gripping an empty box 6 by suction force. In that case the manipulator unit 3 can include or be connected to a vacuum source (e.g. a vacuum pump, not shown) that can be brought in fluid communication with the suction means 22, for providing suction vacuum thereto during operation (to achieve said suction force), as will be clear to the skilled person.

In the present example, the gripper head 9 of the manipulator unit 3 also includes dedicated gripping means 21 (separate of the gripper 22 for holding an empty box 6) for picking up one or more product filled packaging units 4. For example the manipulator head 9 can include a pair of opposite, spaced-apart gripper plates (blades) 21, configured for releasingly holding (e.g. clamping) one or more (e.g. an array) of packaging units 4 therebetween. A manipulator having such gripping blades is know as such, see e.g. EP1502884 and EP1832534. Movement of the plates towards and away from each other is schematically indicated by arrows R5 in FIG. 2. As is indicated in FIGS. 2-3, the gripper head 9 can e.g. pick up a row of two or more (in this case three) packaging units 4 that are positioned next to each other in the first area A1, for simultaneously transporting those units 4 into a box 6 at the loading area PA. In an alternative example (e.g. in case of handling product carrying trays) the gripper head can pick up a single packaging unit and deposit that single unit into a box 6. Besides, alternatively, according to an embodiment, the manipulator head 9 can include dedicated suction means, for example one or more vacuum cups, for gripping one or more packaging units 4 by suction force.

It follows that the manipulator unit 3 can be arranged to iteratively pick-up an empty packaging box 6 from the box feeding track 7 (from the respective second area A1) and to position the box 6 on a pallet 1 supported by the pallet supporter 2 in the loading area PA.

Similarly, the manipulator unit 3 can be arranged to iteratively pick-up a number (one or more) of packaging units 4 from the package feeding track 8 (from the respective first area A1) and to gently deposit the picked-up number of packaging units 4 in a packaging box 6 located on a pallet 1 supported by the pallet supporter 2.

Similarly, the manipulator unit 3 can be arranged to iteratively pick-up an optional spacer structure (e.g. sheet or tray) 15 deposit the picked-up spacer structure 15 onto one or more filled packaging boxes 6 located on the pallet 1 (in the loading area PA).

Further, the system can e.g. include a control unit or controller means CU, e.g. a computer, microcontroller, controller software, hardware and/or the like, for controlling the various system components 2, 3, 7, 8 (such as activating, deactivating, steering, timing and/or synchronization of component actions, etc.), as will be appreciated by the skilled person. The system can include communication links, e.g. wired and/or wireless signal transmission means, for transmitting respective control signals between the control unit CU and other system components 2, 3, 7, 8.

During operation, the system can carry out a method for efficiently packing a large number of product filled packaging units 4 in packaging boxes 6, including (in substantially arbitrary order):

- supporting at least one pallet 1 (in this case a single pallet 1) in a pallet loading area PA;
- the packaging unit conveyer 8 feeding the filled packaging units 4 towards the first area A1 near the pallet loading/supporting area PA;
- the box feeding track 7 feeding empty packaging boxes 6 towards the second area A2 near the pallet loading area PA (spaced-apart from said first area A1);
- moving, by the manipulator unit 3, one or more empty packaging boxes 6 from the second area A2 to the pallet 1 (that is held in its loading position at the loading area PA); and
- iteratively moving, by the same manipulator unit 3, packaging units 4 from the first area into the packaging box 6 supported on the pallet 1.

For example, an empty pallet 1 can be conveyed into the loading area PA by the pallet conveyor 2, to be held by that conveyor 2 during the loading of the pallet 1.

More particularly, an empty box 6 can be placed on the pallet PA first, to be filled with the packaging units 4, before a next empty box 6 is positioned on the pallet 1. Alternatively, a plurality of empty boxes 6 can be positioned onto the pallet 1 next to each other (e.g. in a row or layer), to be subsequently filled with packaging units 4.

Box placement can include: moving the manipulator 9 to an empty box (supplied to and located in the second area A2), the head 9 of the manipulator unit 3 gripping and lifting the empty box 6, and moving the box 6 to pallet loading area via corresponding movement of the articulated arm of the manipulator unit 3.

After a packaging box 6 (or row or layer of boxes 6) has been filled, at least next empty box 6 can be picked up by the manipulator unit 3 from the box feeding track 7 and placed onto the filled box(es) 6. Optionally, an intermediate spacer structure can be placed onto a filled box 6 before a next (empty) box 6 is positioned. As is mentioned before, in that case it is preferred that the manipulator unit 3 is operated for picking up a spacer structure 15 and transferring the spacer structure 15 to the loading area PA, to place the structure 15 onto the filled box (or row or layer of filled boxes).

The filling of placed packaging boxes 6 in particular involves: moving the head 9 of the manipulator unit 3 iteratively to filled packaging units 4 (supplied to and) located in the first area A1, gripping and lifting one or more of the packaging units 4 by the head 9, and moving gripped unit(s) into the box 6 located in the pallet loading area by suitable manipulator arm movement.

In this way, a relatively large stack of filled packaging boxes 6 can be placed onto the pallet 1, by a single manipulator unit 3 and respective feeding means 7, 8. Movement of the various system components 2, 3, 7, 8 can be controlled by said control unit CU (utilizing suitable control signals and communication means as will be clear by the skilled person).

After loading, the loaded pallet, carrying a number of packaging boxes 6 that are all filled with a packaging units 4, can be removed from the pallet loading area, e.g. by the pallet conveyor 2, or another pallet transporter (e.g. a fork lift). After that an empty pallet 1 can be moved into the loading area PA and the above process can be repeated.

In this way, swift and efficient pallet loading can be achieved, a manipulator unit 3 having relatively low loading specifications can be utilized for achieving relatively high cumulative pallet loads. Also in this way a stable stacking of filled boxes onto the pallet can be achieved. Also, in this way, the (outer) packaging boxes 6 can be handled with care. As follows from the above, preferably the manipulator unit 3 only grips and lifts the boxes 6 when they are still empty, so that damage thereto can be prevented.

While the invention has been explained using exemplary embodiments and drawings, these do not limit the scope of the invention in any way, said scope being provided by the claims. It will be appreciated that many variations, alternatives and extensions are possible within said scope, as will be clear to the skilled person from the description and the drawings.

For example, various types of filled packaging units, e.g. product containers 4, can be processed, e.g. substantially closed product containers 4, open product containers, egg trays, egg packs, and/or the-like. The packaging units 4 as such can be light-weight, be made of e.g. plastic or carton or the-like, wherein a filled packaging unit 4 can e.g. have a maximum mass of about 3 kg (depending on the amount of product carried, egg mass and product container mass).

The products to be processed can be eggs or different types of products, e.g. edible products, fruit.

As mentioned before, stacking the packaging boxes 6 onto each other can include stacking boxes 6 directly onto each other (i.e. stacking empty boxes 6 onto filled boxes), for example in layers of packaging boxes 6. Optionally, one or more intermediate structures (e.g. sheets or spacer-means) 15 can be placed between two or more subsequent packaging boxes (or layers) of the stack of boxes. Also, during pallet loading, packaging boxes 6 can be laid horizontally next to each other to form a layer of product containers that is supported by the pallet 1.

In addition or alternatively, stacking packaging units 4 into a box 6 can include stacking filled units 4 (each containing products E) directly onto each other in the box 6, for example in layers of units 4 (as in FIG. 1). In this case also, optionally, one or more intermediate structures (e.g. sheets or spacer-means or empty trays, not shown) can be placed between two or more subsequent packaging units 4 in a box 6, for example by the same manipulator unit 3. Similarly, after a box 6 has been filled, a cover member or cover sheet or empty cover tray (not show) can be placed on the stack of packaging units 4 that is held by that box 6, for example by the same manipulator unit 3.

Each of the packaging boxes 6 can be configured to be filled with a predetermined amount of the packaging units 4, for example by at most 20 packaging units 4, more particularly by about 12 packaging units.

In one embodiment, a maximum mass of a filled box 6, being filled with packaging units 4 that are all filled with products E, can be such that it can be lifted by a single person, e.g. a mass of at most 30 kg, preferably at most 20 kg. Alternatively, a mass of a filled box 6, being filled with packaging units 4 that are all filled with products E, can be significantly larger than 30 kg, e.g. in the range of about 50-250 kg.

Further, for example, the system can be configured for handling various types of pallets 1 as will be clear to the skilled person, e.g. wooden pallets, pallets that are configured to be lifted by forklifts, EURO or EPAL or Düsseldorfer pallets or the-like. The pallet 1 can e.g. be configured to safely carry at least 750 kg load, e.g. at least 1,000 kg load.

Besides, the gripper head 9 can be configured in different ways for picking up filled packaging units 4, e.g. by including opposite gripping elements or plates 21, and/or using suction means (such as via one or more suction cups) or in a different manner.

Moreover, in an embodiment, the manipulator unit 3 can be operated to lift a number of filled packaging units 4 at the same time, or to lift an empty packaging box 6.

Alternatively, the system can include a mode of operation wherein the manipulator unit lifts and holds one or more filled packaging units 4, and lifts an empty packaging box 6, and moves the packaging unit(s) 4 and packaging box 6 simultaneously to the loading area PA for stacking (e.g. placing the packaging box 6 first and placing the packaging units 4 next into the placed, or another, packaging box 6).

Also, in an embodiment, the manipulator unit 3 can be configured to lift a plurality (e.g. two or three) empty packaging boxes 6 out of the second area A2 at the same time, for simultaneously transferring the empty boxes 6 to the pallet 1 to be loaded.

The invention claimed is:

1. A system for handling packaging units, comprising:

a pallet supporter configured for supporting at least one pallet;

a package feeding track for feeding the packaging units towards a first area next to the pallet supporter;

a box feeding track for feeding empty packaging boxes towards a second area next to the pallet supporter, wherein the empty boxes receive a stack of the packaging units; and a manipulator unit configured to move an empty packaging box from the box feeding track onto a pallet supported by the pallet supporter, wherein the manipulator unit is also configured to move the packaging units into the packaging box supported on the pallet supported by the pallet supporter, the manipulation unit having a gripper head, the gripper head including a suction gripper configured for releasingly holding the empty box by a single side wall of the box and spaced apart gripper plates configured for releasably holding the packaging units, and wherein the gripper head is configured to simultaneously hold an empty packaging box and at least one packaging unit.

2. The system according to claim 1, wherein the pallet supporter is a pallet conveyor, configured for conveying pallets to and/or away from the manipulator unit.

3. The system according to claim 1, wherein the gripper head is movable in three orthogonal directions.

4. The system according to claim 1, wherein the manipulator unit is arranged to iteratively pick-up a number of packaging units from the package feeding track and to deposit the picked-up number of packaging units in a packaging box located on a pallet supported by the pallet supporter.

5. The system according to claim 1, wherein the system is configured for handling packaging boxes and packaging units having rectangular boundaries and a rectangle-shaped supporting surface.

6. The system according to claim 1, wherein the system includes an intermediate structure delivery station, for providing spacer structures, next to the manipulator unit, wherein the manipulator unit is also configured for transferring spacer structures from a respective station to a pallet loading area, for covering one or more boxes that have been loaded on a pallet.

7. The system according to claim 1, wherein each packaging unit is a closed egg container, holding a plurality of eggs, wherein each packaging box is configured to receive a plurality of the egg containers, as a stack of egg containers.

8. The system according to claim 1, wherein the packaging units are stackable egg trays holding eggs.

9. The system according to claim 1, further comprising an intermediate structure delivery station, for providing spacer structures, wherein the manipulator unit is configured for transferring spacer structures from the intermediate structure delivery station to the pallet loading area for covering one or more boxes that have been loaded on a pallet.

10. A method for handling closed egg containers, each closed egg container holding a plurality of eggs, the method comprising:

supporting a pallet in a pallet loading area;

feeding the closed egg containers towards a first area;

feeding empty packaging boxes towards a second area that is spaced-apart from said first area;

moving, by a manipulator unit, an empty packaging box from the second area onto the pallet, the manipulator unit having a manipulator head, the manipulator head including a gripper configured for releasingly holding a single empty box by a single wall of the box, wherein the manipulator head is configured to move the closed egg containers; and stacking layers of egg containers into the box by iteratively moving, by the same manipulator unit, egg containers from the first area into the box supported on the pallet.

* * * * *